US005546636A

United States Patent [19]

Mandl et al.

[11] Patent Number: 5,546,636

[45] Date of Patent: Aug. 20, 1996

[54] COMBER MACHINE

[76] Inventors: Gerhard Mandl, Strehlgasse 8, CH-8311 Brütten; Hans-Peter Meile, Pestalozzistrasse 12, CH-8404 Winterthur, both of Switzerland

[21] Appl. No.: 410,891

[22] Filed: Mar. 27, 1995

[51] Int. Cl.[6] ..... D01G 19/04

[52] U.S. Cl. ..... 19/231; 19/223; 19/225

[58] Field of Search ..... 19/215, 223, 224, 19/225, 231

[56] References Cited

U.S. PATENT DOCUMENTS

| | | | |
|---|---|---|---|
| 2,558,706 | 6/1951 | Hinson | 19/223 |
| 3,479,699 | 11/1969 | Von Kaenel et al. . | |
| 3,600,758 | 8/1971 | Von Kaenel et al. | 19/225 |
| 3,604,063 | 9/1971 | Von Kaenel et al. | 19/231 |

FOREIGN PATENT DOCUMENTS

| | | |
|---|---|---|
| 485873 | 3/1970 | Switzerland . |
| 1207441 | 9/1970 | United Kingdom . |

*Primary Examiner*—John J. Calvert
*Attorney, Agent, or Firm*—Martin A. Farber

[57] ABSTRACT

A comber machine with a nipper head (3) has a fixed bearing (2), and at least one pair of detaching rolls (6") which are rotatably mounted in bearings (41). The nipper head (3) and the detaching rolls (6") are moved during a combing cycle towards one another and away from one another by the distance of a stroke path, up to a minimum distance which corresponds to a predetermined separation value. While still maintaining the stroke path, the predetermined separation distance (ecartement value) can be adjusted. To facilitate the setting of the ecartement value, provision is made for bearings (41) of the detaching rolls (6") to be displaced relative to the fixed bearing (2) of the nipper head (3), jointly on a track (45) which enlarges or reduces the separation value.

14 Claims, 3 Drawing Sheets

COMBER MACHINE

FIELD AND BACKGROUND OF THE INVENTION

The present invention relates to a comber machine having a nipper head and an assembly of detaching rolls, wherein the nipper and the detaching rolls can be moved relative to each other during a combing cycle.

Modern combers go back to the pioneering designs of John William Nasmith, of about 1920. They feature oscillating nippers, reversing detaching rolls, half-lap and cleaning brushes. The separation of the fiber assembly is effected by a simultaneous back oscillation of the nippers, and a forward rotation of the detaching rolls. The detaching rolls then reverse, and in this way feed the combed tuft back again, in such a manner that the newly-combed fiber tuft can be laid on it. This is the process known as "piecing".

The quantity of comber noil which is screened out is determined by the detachment length, which is referred to as the "ecartement" (separation). By definition, the ecartement is that distance which pertains between the clamping line of the inner detaching rolls and the clamping line of the nipper knife and the cushion plate, when the oscillating nipper is closest to the clamping line of the inner detaching rolls.

The size of the ecartement determines the length of the fiber tuft which protrudes freely when the nippers are closed, and is combed through by the needle segment of the half-lap. With the fiber length distribution in the fiber tuft remaining uniform, the greater the ecartement, the more fibers are combed out. Accordingly, as the ecartement increases, so the amount of separated comber noil rises and, conversely, as the ecartement decreases the amount of noil drops. All known combers essentially control the separation of the noil due to the possibility of changing this "ecartement" value, which is determined on the machinery side, with the ecartement essentially being altered by the readjustment of the outer reversing point of the nipper movement (U.S. Pat. No. 3,479,699=Switzerland Patent 485 873). The axes of the driven detaching rolls are spatially fixed. The detaching rolls only carry out an oscillating, step-and-repeat (pilgrim step like) type of rotational movement, in order to allow for the separation of the fiber assembly and the piecing.

The adjustment of the ecartement by changing the nipper movement is, from the mechanical point of view, relatively easy to carry out in the main drive unit. It is necessary, however, for the machine to be shut down, and for the adjustment to be carried out in the hot and oily gearbox. To obtain an exact adaptation of the amount of noil, the procedure needs to be repeated frequently, resulting in considerable expenditure of time and loss of production.

In addition to the gearbox-side adjustment of the noil separation in U.S. Pat. No. 3,479,699, it is also possible to effect an adjustment of the separation by making provision for swivelling the upper, inner detaching roll about the axis of rotation of the lower detaching roll, in order at least to reduce the amount of work involved when making only minor adjustments to the ecartement.

In the wool processing industry in particular, combers are known which do not follow Nasmith' design principle (see UK-Patent 1 207 441), but rather the older design by Hellmann. In this case, the detachment movement is effected not by the nippers swinging backwards, but exclusively by a corresponding movement of the axis of the detaching rolls in forward direction. The nipper moves up and down in the rhythm of the rotation of the machine; the detaching rolls move in the rhythm of the machine both rotationally as well as in a transitional direction from rear to front and back again. As a result, per machine cycle, the axis of the detaching cylinder moves outward in one movement, and then back in again. The separation as in the case of the Nasmith machine is determined by adjusting the inside reversing point of the detaching roll oscillation.

In view of the fact that the oscillating masses are high in this type of design, large forces of inertia are produced if the detaching rolls move abruptly. The Heilmann design is therefore not well-suited for high combing cycle frequencies, and therefore not for combers with high production rates.

SUMMARY OF THE INVENTION

The task of the invention is to provide improvements to a comber of the type described above which will allow for the simple and rapid adjustment and setting of the ecartement, without the machine necessarily having to be taken out of production.

According to the invention, this task is accomplished by a comber machine having a nipper head and an assembly of detaching rolls which can be moved relative to each other during a combing cycle, and wherein bearings supporting the rolls are displaceable along a track.

This enables the comber noil separation to be changed very simply at any time, even with the machine running, either progressively or in small increments. The control, and adaptation of this vital characteristic value, "noil separation" in a spinning mill is accordingly faster, with higher precision, with less time expenditure, and without loss of production.

The adjustment of the ecartement value, according to the invention, is attained by an independent joint displacement of all aligned detaching rolls. Displacement can be linear, on an arc, or on any other curve which is to the purpose. Relative to the movement of the machine and the combing process, the displacement of the detaching rolls is relatively minor, and the adjustment is effected independently of the machine cycle. The functions of the detaching rolls (drawing-off and piecing) continue to be effected by the known step-and-repeat type of rotational movement.

BRIEF DESCRIPTION OF THE DRAWINGS

The invention is explained by way of examples based on the appended schematic representations. These show.

DETAILED DESCRIPTION OF THE PREFERRED EMBODIMENTS

Figure 1:
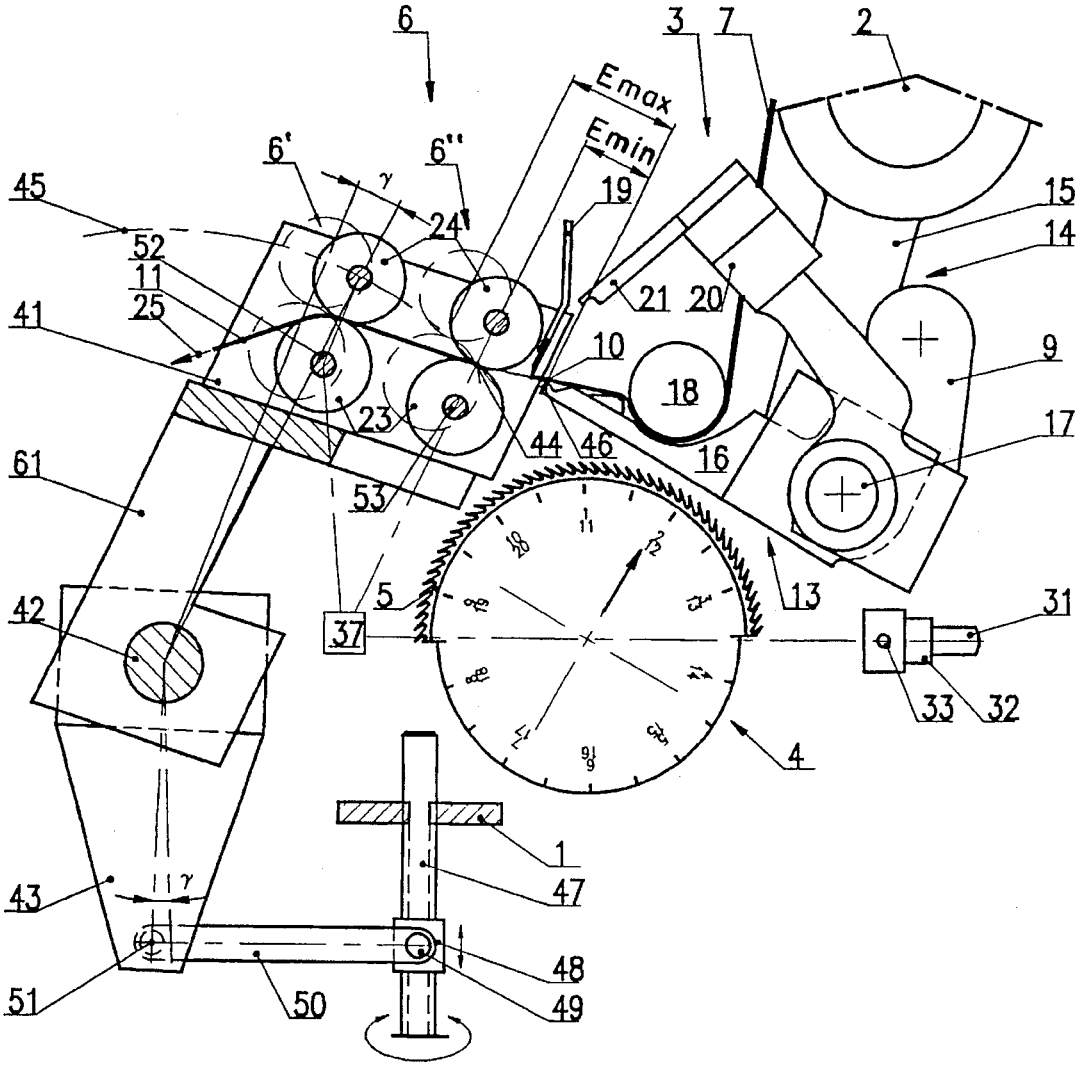
FIG. 1: A side view of the essential parts of a comber, with the movement and setting mechanism for the ecartement.

FIG. 1 shows the principle structure of a comber as described and shown specifically in the aforementioned U.S. Pat. No. 3,479,699. In the machine frame 1, a nipper head 3 is mounted so as to be swingable about a nipper axis 2, a half-lap 4 with a needle segment element 5 being associated with the nipper head 3. The nipper head 3 cooperates with detaching rolls 6. A fiber assembly or wad 7 delivered for combing is conducted continually to the nipper head 3 from a lap (not shown). The advancing end of the wad 7, emerging from the nipper, is referred to as the fiber tuft 10, and is conveyed away after piecing with the combed material of a web 11. The web 11 is held between the detaching rolls 6 and fed back in a step-and-repeat type of movement (pilgrim step like), and is detached from the following fibers of the wad 7. The needle segment 5 is cleaned of the comber noil which is combed out of the freely-suspended fiber tuft 10 by means of a brush roller, not shown, which rotates in the same direction as the half-lap 4 at a higher rate of speed.

The nipper head 3 features a lower nipper plate 13 and a nipper knife plate 21, mounted on bearings in a swingable manner. The lower nipper plate 13 consists essentially of a nipper plate arm 15 and a cushion blade 16 secured to it. At a lateral swivelling journal 17 of the lower nipper plate 13, an upper nipper plate 14 is swingably mounted on bearings; in the lower nipper plate 13, a feed roller 18 for the wad 7 is also mounted on bearings. This converts the continuous fiber feed into a discontinuous feed. An intermittent drive of the feed roller 18 is accomplished in the rhythm of the nipper head movement, by means of a pawl drive which is not shown, but which is described in the aforementioned U.S. Pat. No. 3,479,699.

The upper nipper 14 consists essentially of a nipper knife arm 20 linked to the swivel journal 17. The knife plate 21 is secured to the arm 20, as well as a lever 9, likewise secured to the arm 20. In addition to this, the upper nipper plate 14 is provided with an adjustable penetration comb 19, which keeps back those fibers of the fiber tuft 10, which do not feature the correct length of the detachment gap (the separation), from being drawn into the detaching rolls 6. The knife plate 21 is swivelled in the movement rhythm of the nipper head 3 against the cushion plate 16, or swivelled away from it. As a result, the nipper head 3 is open in the outer end position (as shown in FIG. 1), and is closed in the inner end position (in which the cushion plate 16 is furthest removed from the clamping point of the detaching roll 6), and clamps the fiber tuft 10 firmly. The synchronization of the movement of the upper nipper plate 14 with the movement of the nipper head 3 is effected by means of a linkage device, not shown, the ends of which are connected on the one hand to the machine stand 1 and, on the other, to the lever 9 which is secured to the nipper knife arm 20.

The detaching rolls 6 are formed by two pairs of detaching rolls 6', 6", each of which has a lower, driven detaching roll 23 and an upper detaching roll 24. Their periodic step-and-repeat, forwards and backwards (pilgrim step), movement has the effect, in forwards movement (as already mentioned) of conveying the combed web 11 in the direction of the arrow 25, and, in backwards movement, causes a piecing with the combed fiber tuft 10, which is delivered by the nipper head 3.

The drive for the comber machine is effected by means of a motor 31, which drives a timing shaft 33 by means of a reduction gear 32. With each revolution of the timing shaft 33, the machine completes one combing cycle. Likewise, in cycled synchronism with the timing shaft 33, the lower detaching rolls 23 are driven by means of a known design of step-and-repeat gear 37, in such a way that their forward and backward movements are effected in the same manner as on known comber machines during a combing cycle.

The detaching rolls 6 are rotatably mounted in bearings on a pillow block 41, and, as mentioned, are driven by the step-and-repeat gear 37. Alternatively, the drive system might employ a reversible electric motor (not shown). The pillow block 41 is mounted securely on a part 61 of the machine, which is connected to a lever 43 fixed in rotation by means of a swing shaft 42, mounted in bearings in the machine frame 1. By means of the application of a displacement of the lever 43, by the swivelling the shaft 42, the detaching rolls 6 are moved against the nipper head 3, or away from it, and the clamping line 44 of the inner pair of detaching rolls 6" is displaced along a circular track 45. This allows for the alteration of the ecartement E, which is the smallest distance between the clamping line 46 (the bite of cushion plate 13 and nipper knife plate 21) and the clamping line of the detaching rolls 6". This smallest value is obtained when the nipper 3 is at its most outward position, as shown in FIG. 1. FIG. 1 further shows, by the full lines, the detaching roll 6 in its closest possible position to the nipper head 3, this being the smallest separation E, for which the machine is designed. The dotted lines show the maximum value of the separation E. When the swivelling shaft 42 rotates counter-clockwise, the ecartement E increases up to a maximum value determined by the design of the machine, which can be limited by means of a stop, either fixed or movable, which limits the swivelling path of the shaft 42. The displacement or swivelling of the shaft 42 is created by means of a threaded spindle 47, rotatably mounted on bearings in the machine frame 1, which can be driven by hand or by means of a motor. Located on the threaded shaft of the spindle 47 is a nut 48, with an axle journal 49, on which one end of a linkage element 50 is connected. The other end of the linkage is connected to a swivelling journal 51 of the lever 43. The threaded spindle 47 and the lever 43 are parallel at the setting of the smallest separation value E, and the linkage element 50 is oriented at right angles to a central longitudinal axis of the lever 43. If the spindle 47 is rotated, the nut 48 is displaced upwards or downwards, and the shaft 42 swivels by means of the linkage 50 and the lever 43 about an angle, in which situation the detaching rolls 6 are moved into the position indicated by the dotted lines, and the ecartement E increases in either case.

The embodiment shows the axes of the detaching rolls 6—irrespective of the other movements which they perform for the conveying and piecing of the wad—movable on an arc-shaped track 45. It is possible for the track 45 to create a travel path which is flatter, or in a straight line, or otherwise curved. In this case, the pillow block 41 would accordingly need to be mounted on a crank arm (instead of a swing lever), or in correspondingly shaped guide curves secured to the machinery frame 1. Likewise, the displacement movement for the detaching rolls 6 could be effected by a motor with an increment generator associated with it, instead of by hand. In addition, instead of the reduction for the adjustment movement shown, other mechanical reduction gears are suitable, in the same manner.

Figure 2:
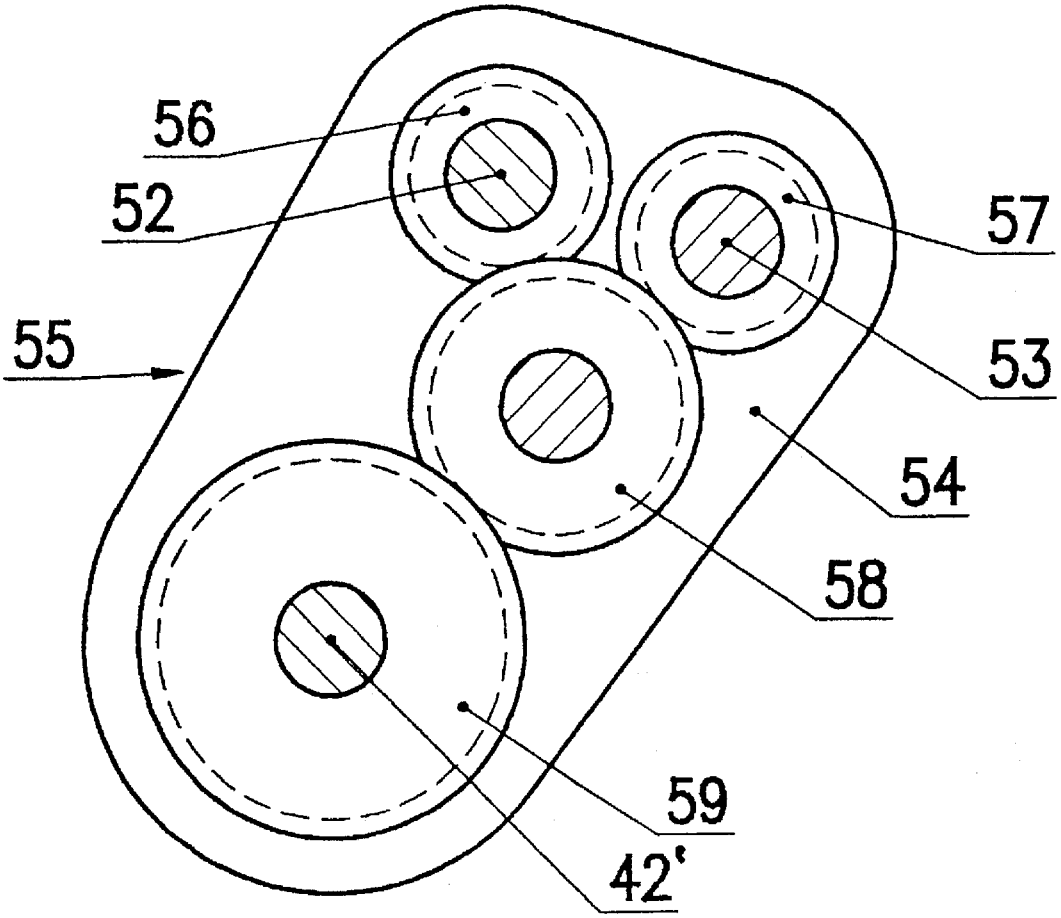
FIG. 2: A representation of the drive system for the detaching rolls.

The driven detaching rolls 23 are each positioned in a coupled manner on shafts 52 and 53 respectively, which are freely rotatable in the pillow block 41. These shafts, 52 and 53 are further rotatably mounted in an intermediate gearbox housing 54 of an intermediate gear system 55, secured to the pillow block 41 (FIG. 2). The intermediate gear box 55 is the transmission system between the step-and-repeat gear system 37 and the shafts 52 and 53. Located in the intermediate gearbox housing 54 on each of the shafts 52, 53 are gear wheels, 56 and 57 respectively, of the same size. The two toothed wheels 56, 57 mesh with an intermediate gear wheel 58, mounted so as to be freely rotatable in the housing 54; this intermediate gear wheel meshes in turn with a gear wheel 59. The gear wheel 59 is mounted in a rotationally-resistant manner on a shaft 42', which passes through the housing 54, and is located co-axially in relation to the swivelling shaft 42, capable of being driven in a periodic backwards and forwards movement by the step-and-repeat gear system 37. The intermediate gear housing 54 is swingably mounted so as to be capable of swivelling on the shaft 42', or so as to swivel on the machine frame about the axis of the shafts, 42 respectively 42'. When the ecartement value E is adjusted, the housing 54 is swivelled with the shafts 52, 53 and the gears 56, 57, 58 around the axis of the shaft 42'. The gears 56, 57, 58, 59 remain thereby in mutual engagement all the time, with the result that the adjustment can be made with the machine running. Instead of the gear wheel drive shown, a chain drive or similar arrangement can also be used instead of an intermediate gear 55.

Figure 3:
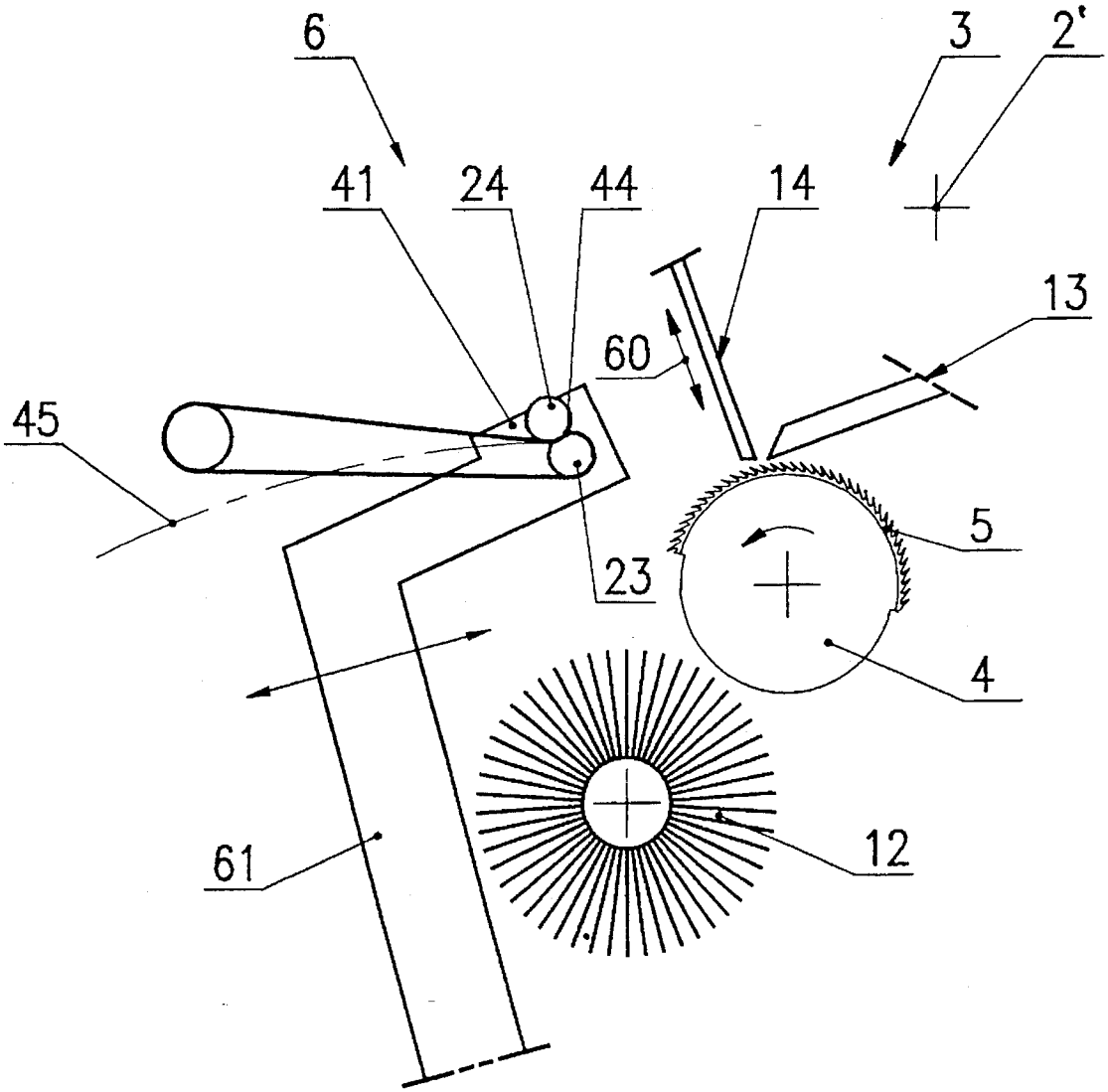
FIG. 3: A side view of a further embodiment of the invention.

While, with the embodiment described above, the nipper axis 2 represents a fixed bearing for the movable nipper head 3, in relation to which the bearing 41 of the detaching rolls 6 can be adjusted, in the case the comber machine described in the aforementioned UK-Patent 1 207 441, a fixed bearing 2' of this type is provided for the nipper head 3, which moves upwards and downwards in the direction of the double arrow 60 (FIG. 3). The degree of adjustability of the detaching rolls, according to the invention, is also effected with such a machine, in relation to this fixed bearing, inasmuch as the detaching rolls 6 can be moved and adjusted with the pillow block 41, relative to the oscillating link 61 which is suspended about their stroke path.

We claim:

1. A comber machine comprising:

a nipper head pivotable about a fixed-position bearing;

at least two detaching rolls and bearings for rotatable mounting of the rolls;

the rolls being provided in pairs;

wherein the nipper head and a pair of the detaching rolls are movable relative to one other during a combing cycle along a stroke path, up to a predetermined separation value;

the machine further comprises means for adjusting the predetermined separation while still maintaining the stroke path;

at least the bearings of the detaching rolls which are closest to the nipper are displacable relative to the fixed-position bearing of the nipper head, jointly along a track for increasing or reducing the separation value, and is fixable in at least some of the displacement settings.

2. A comber machine according to claim 1, wherein the fixed-position bearing is a swivelling axis of the nipper head at which the head is mounted for swivelling about the stroke path, relative to the detaching rolls.

3. A comber machine according to claim 1, further comprising a movable machine part, and wherein, the nipper head is mounted at the fixed-position bearing for vertically tilting the nipper head up and down; and the bearings of the rolls are connected to the movable machine part for movement along the stroke path relative to the nipper head, the bearings displacable and adjustably located, relative to the movable machine part, in the direction of the stroke movement.

4. A comber machine according to claim 1, wherein the bearings of the detaching rolls are movable and locatable on the track.

5. A comber machine according to claim 4, wherein said track is straight.

6. A comber machine according to claim 4, wherein said track is curved.

7. A comber machine according to claim to claim 4, wherein said track is a circular arc.

8. A comber machine according to claim 1, further comprising repeat means connected to at least one of the detaching rolls to institute a step-and-repeat movement of the at least one detaching roll during a displacement of bearings while maintaining a drive connection to the rolls.

9. A comber machine according to claim 1, further comprising additional pairs of the detaching rolls and, wherein bearings of all the detaching roll pairs are movable and locatable jointly along the length of the track.

10. A comber machine according to claim 1, further comprising a frame, a pillow block, a lever rotatable about a lever axis to the frame, and a spindle; and wherein the pillow block is connected to the lever, and a position of the lever is set selectively by the spindle relative to the frame.

11. A comber machine according to claim 10, wherein the lever has a first part and a second part, the machine further comprises a link and a screw nut; and wherein the lever connected via the first part to the pillow block and via the second part to the link;

the link interconnects the lever with the screw nut, and the screw nut rides along the spindle.

12. A comber machine according to claim 11, wherein the linkage and the spindle are arranged at right angles to one another, when the machine is set to a smallest value of the predetermined separation.

13. A comber machine according to claim 10, further comprising repeat means to institute a step and repeat movement of the detaching rolls relative to the nipper head, the repeat means comprising a driver gear rotatable about an axis parallel to the lever axis, the repeat means further comprising an intermediate gear and two further gears coupled via the intermediate gear to the driver gear; and wherein the detaching rolls are fixed respectively to the further gears.

14. A comber machine according to claim 13, further comprising a housing; and wherein the driver gear is coaxial to the lever axis;

the gear wheels are located in the housing, and the housing is pivotable about the lever axis.

* * * * *